United States Patent [19]

Abate, Sr. et al.

[11] 4,024,729

[45] May 24, 1977

[54] REFRIGERATED MILK CONTAINER

[76] Inventors: Rudolph Abate, Sr.; George Spector, both of 3615 Woolworth Bldg., 233 Broadway, New York, N.Y. 10007

[22] Filed: Nov. 24, 1975

[21] Appl. No.: 634,584

[52] U.S. Cl. ..... 62/263; 312/101; 312/218

[51] Int. Cl.[2] ..... F25D 23/12; A47B 81/00; E05B 65/46; E05C 13/04

[58] Field of Search ..... 62/263, 259; 312/242, 312/101, 236, 218, 222; 292/332

[56] References Cited

UNITED STATES PATENTS

| | | | |
|---|---|---|---|
| 681,155 | 8/1901 | Tobey | 312/218 |
| 858,982 | 7/1907 | Heinitz | 312/218 |
| 1,069,412 | 8/1913 | Greene | 312/101 |
| 2,579,379 | 12/1951 | Fritsche | 62/263 |
| 2,823,972 | 2/1958 | Saunders | 312/242 |
| 2,848,880 | 8/1958 | Riedel et al. | 62/263 |
| 3,078,682 | 2/1963 | Gould | 62/263 |
| 3,708,997 | 1/1973 | McLaughlin | 62/263 |

*Primary Examiner*—Lloyd L. King

[57] ABSTRACT

A refrigerated box mounted through an outside wall of a house and which is used by a home delivery route milkman to deposit bottles of milk therein; the box having a door on its outer side for access to the milkman and a door on its inner side for allowing a resident inside the home to remove the milk; a lock automatically locking the outer door when closed, and a hidden lock release being made known only to the milkman so to prevent other strangers from access to the box interior.

4 Claims, 6 Drawing Figures

REFRIGERATED MILK CONTAINER

This invention relates generally to home milk delivery devices. More specifically it relates to refrigerators.

A principal object of the present invention is to provide a refrigerator that is made available out-of-doors for a home delivery of milk, eggs, cheese, butter, and the like therein so that the same are maintained fresh before a home resident picks it up and places it into his refrigerator in the kitchen.

Another object is to provide a milkman delight refrigerator which accordingly would overcome the spoilage of dairy products particularly during the hot summer months of the year when milkmen leave the same outside of a residence front door, and where it is subject to being stolen or raided by stray dogs or other animals.

Still another object is to provide a milkman delight refrigerator which would accordingly increase the sale of home delivery dairy products.

Still a further object is to provide a milkman's delight refrigerator which would be ideal for business people who are away from home for many hours so that the delivered dairy products are left for a long time where the milkman left them.

Still a further object is to provide a milkman's delight refrigerator which is installed through an outside wall of a house and which has an outside access door for use by the milkman to leave his delivery therein, and an inside door for access by the residents from within the house so that they do not have to step outside to remove the delivered products, and which would be especially appreciated in rainy or cold winter weather.

Other objects are to provide a milkman's delight refrigerator which is simple in design, inexpensive to manufacture, rugged in construction, easy to use and efficient in operation.

These and other objects will become readily apparent upon a study of the following specification and the accompany drawing wherein.

Figure 1:
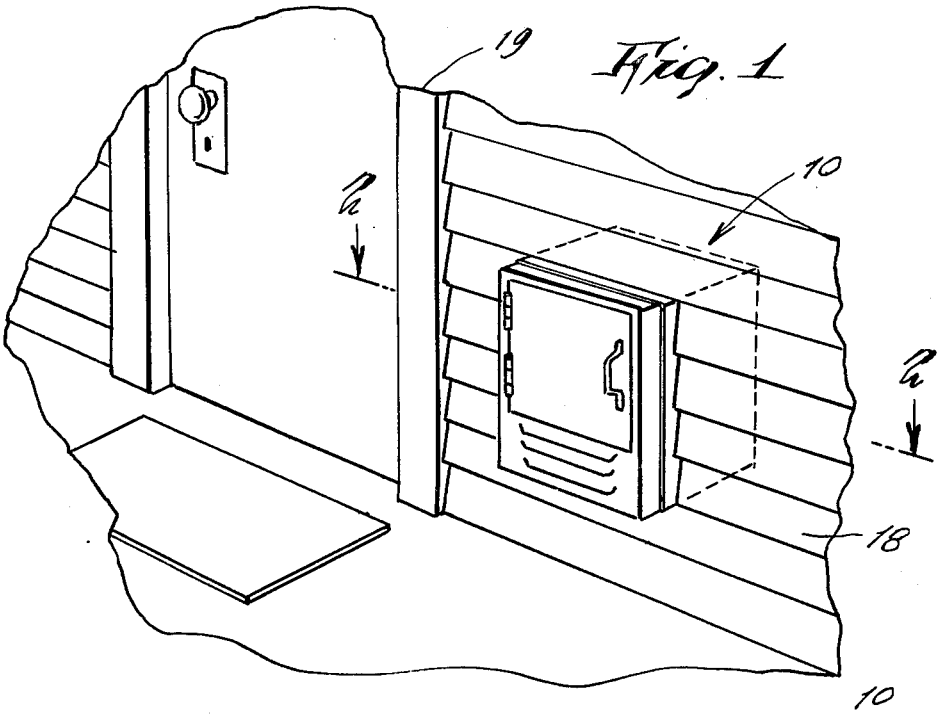
FIG. 1 is a perspective view of the invention as viewed from an outside of a house.
Figure 2:
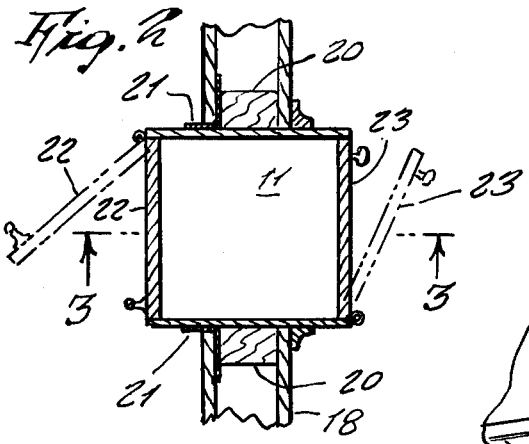
FIG. 2 is a downward cross sectional view taken on line 2—2 of FIG. 1.
Figure 4:
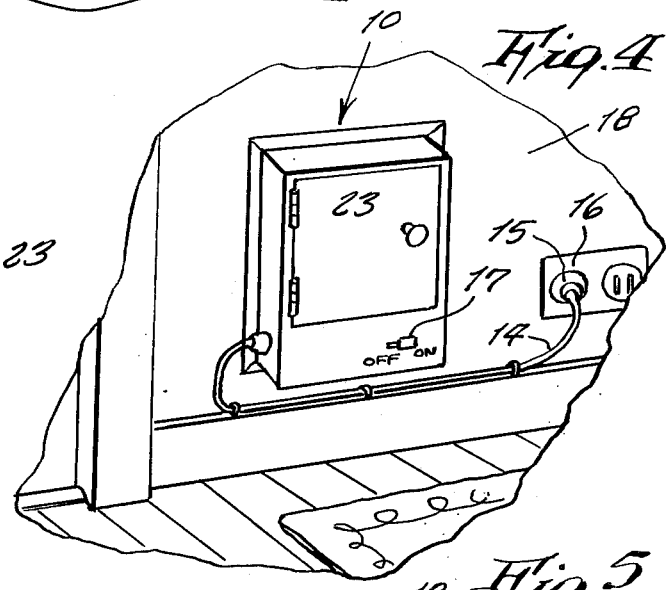
FIG. 4 is a perspective view of the invention.

Referring now to the drawing in greater detail, and more particularly to FIGS. 1 through 5 thereof at this time, the reference numeral 10 represents a milkman's delight refrigerator according to the present invention wherein the same includes a metal box 11 that may or may not include shelves and which serves to hold dairy products 12. A refrigerating mechanism 13 under a lower end of the box is electrically driven through extension cord 14 and plug 15 attachable in a household electric outlet socket 16, and is controlled by a switch means 17.

The refrigerator may be made 14 × 14 × 22 inches as an ideal size for most persons, and is mounted so to extend through an outside wall 18 of a house 19, where it is mounted between wall studs 20. Copper flashing 21 is provided around its top and sides where the refrigerator protrudes outwardly of the wall so to prevent rain entering the wall interior.

There is a hinged door 22 on the outside end of the box, and a hinged door 23 on the inside end of the box, both doors being rubber gasketed such as in conventional refrigerators so to retain coolness therewithin. Both doors are of metal, the inside door 23 being additionally possibly covered by wood or other material so to suit a decor of a room into which it opens.

The box includes a shelf 24 pivotable about a pin 25, the shelf being upwardly pivoted by a compression coil spring 26 therebeneath. When a milkman deposits products in the box they rest upon the shelf, thus causing it to pivot down against the action of the spring, so that a downward hook 27 on the shelf is in alignment for engaging an upward hook 28 of the door when the milkman then closes the door after making delivery, so that the door thus locked, and any stranger cannot thereafter open the same so to take the delivered products. It is understood that prior to deposit of the products in the box, the door is unlocked for access by anyone to the box interior.

Figure 3:
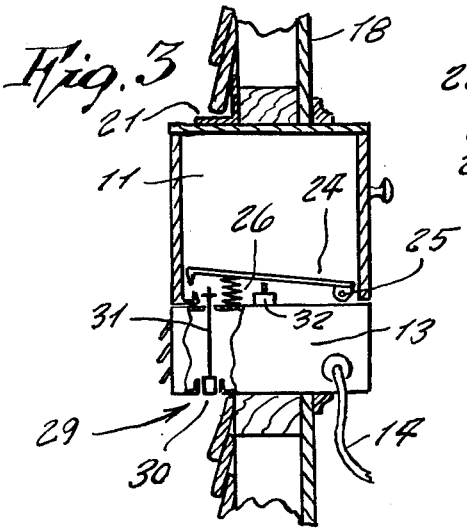
FIG. 3 is a side cross sectional view taken on line 3—3 of FIG. 2.
Figure 5:
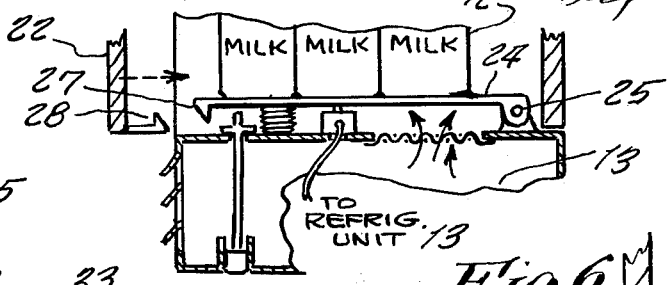
FIG. 5 is an enlarged detail of FIG. 3 showing the door locking mechanism more specifically.

In case the door is locked by anyone other than by a milkman by placing some object on the shelf, or in case a milkman wishes to reopen the box after having closed it, such as to add a delivered item, there is provided a lock release 29 that is hidden but which is made known only to the milkman. The lock release 29 includes a push botton 30 exposed on an overhanging underside of the refrigerator, the push button 30 exposed on an overhanging underside of the refrigerator, the push button being at a lower end of vertical rod 31 that is upwardly slidable against the underside of the shelf so to pivot the shelf upward and disengage with the door hook 28. As shown in FIGS. 3 and 5, a switch 32 is closed by the shelf when depressed so to start operating the refrigerator mechanism 13.

In operative use, it is now evident that a milkman can thus deliver dairy products to a home and place them in a refrigerator without need to enter the home.

Figure 6:
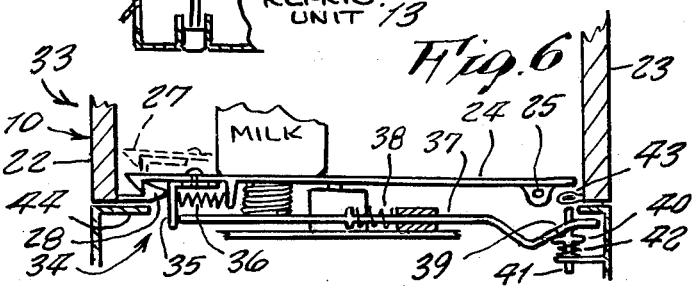
FIG. 6 is a view similar to FIG. 5, and showing additionally an automatic lock system that prevents inside door to be opened up when the outside door is open, thus preventing any vandal from throwing anything such as a burning torch inside in interior of the house and causing damage.

In FIG. 6, a milkman delight refrigerator 33 is shown which is the same as above described refrigerator 10 except that is additionally includes an automatic lock system 34 that prevents the inside door to be opened up while the outside door is open so that no outside person can have access to anythingwithin the interior of the home. In this design, an angle plate 35 is supported slidably underneath the shelf 24 and is pushed by a compression coil spring 36 so to abut against hook 27 when the shelf is empty and raised, as shown by the dotted lines in FIG. 6. This permits a horizontal rod 37, which abuts against the angle plate, to be slided by means of a compression coil spring 38 so that an angularly inclined opposite end 39 of the rod 37 is moved away from a shoulder 40 formed on a vertical pin 41 so that the pin is freed to be slided upwardly by means of a compression coil spring 42 so that the upper end of the pin engages an eye bolt 43 rigidly affixed to inside door 23, so that the inside door is thus locked and cannot be opened which the outside door 22 is open. Even if any object such as a delivery of milk bottle 12 is placed upon the shelf, and the shelfis thus lowered, the inside door remains locked because the outside door is open during this loading operation, and when the shelf is thus pivoted downward from the weight of the milk bottle, the angle bracket, being in the position shown by the dotted lines comes to rest upon the stationary frame 44 of the box so that it cannot effect sliding the horizontal rod and thus unlock the inside door. However, when the outside door 22 is closed, the door hook 28 pushed against the angle plate, pushing it off the frame 44 so that the angle plate drops in front of the end of the horizontal rod 37. The continued closing action of the outside door causes the door hook 28 to push the angle plate further so to push the horizontal rod 37 whereby the inclined end 39 of the rod 37 is thus moved over the pin shoulder 40 causing the pin to be depressed downward against spring 42 so that the pin 41 disengages with the eye bolt 43 thus unlocking the inside door. Thus the inside door is unlocked only when the outside door is closed and there is no danger of any vandal or mischiefour person having access directly into the house interior.

While various changes may be made in the detal construction, it is understood that such changes will be within the spirit andscope of the present invention as is defined by the appended claims.

What is claimed is:

1. The combination of a refrigerated box and a wall comprising a box with a refrigerating unit mounted under the bottom side of said box, said box being mounted in an opening in said wall, said box having a hinged outside door at one end and a hinged inside door at an opposite end, including a shelf mounted inside said box vertically movable relative to said bottom side, said shelf having a downward hook engagable with an upward hook of said outside door when said shelf is moved downwardly against a compression spring to lock the outside door, said shelf in downward position engaging a switch on said bottom side to close an electric circuit to actuate the refrigerating unit, whereby placement of packages on said shelf moves said shelf to the downward position.

2. The combination as set forth in claim 1 wherein a lock release is provided comprising a push button projecting hidden under an outside overhanging portion of said box adjacent to outside door, said push button being affixed to a extending through said bottom side and push rod bearing against the underside of said shelf, whereby movement upwardly of said button moves the shelf upwardly to disengage said hooks.

3. The combination as set forth in claim 2, wherein said refrigerator includes an inside door lock mechanism which locks the inside door when the outside door is open.

4. The combination of claim 3 wherein said mechanism comprises an angle plate slidably supported on an underside of said shelf a second compression coil spring urging said angle to plate against said shelf hook, a horizontal rod slidable by said angle plate against a third compression coil spring, an angularly inclined end on said horizontal rod bearing down against a shoulder of a vertically slidable pin against a force of a fourth compression coil spring, an upper end of said pin being engagable in en eye bolt secured to said inside door.

* * * * *